US010857584B2

(12) United States Patent
Yabuoshi

(10) Patent No.: US 10,857,584 B2
(45) Date of Patent: Dec. 8, 2020

(54) METHOD OF MANUFACTURING PIPE ASSEMBLY

(71) Applicant: TOYOTA JIDOSHA KABUSHIKI KAISHA, Toyota (JP)

(72) Inventor: Masahito Yabuoshi, Chiryu (JP)

(73) Assignees: TOYOTA JIDOSHA KABUSHIKI KAISHA, Toyota (JP); KOBE STEEL, LTD., Kobe (JP)

( * ) Notice: Subject to any disclaimer, the term of this patent is extended or adjusted under 35 U.S.C. 154(b) by 196 days.

(21) Appl. No.: 16/038,307

(22) Filed: Jul. 18, 2018

(65) Prior Publication Data

US 2019/0022732 A1 Jan. 24, 2019

(30) Foreign Application Priority Data

Jul. 24, 2017 (JP) ..... 2017-142586

(51) Int. Cl.
*B21D 26/14* (2006.01)
*B21D 39/04* (2006.01)

(52) U.S. Cl.
CPC ..... *B21D 26/14* (2013.01); *B21D 39/04* (2013.01); *B21D 39/046* (2013.01); *Y10T 29/49803* (2015.01)

(58) Field of Classification Search
CPC ..... B21D 26/00; B21D 26/14; B21D 39/04; B21D 39/046; B21D 39/048; Y10T 29/49622; Y10T 29/4994; Y10T 29/49803
See application file for complete search history.

(56) References Cited

U.S. PATENT DOCUMENTS 3,618,350 A * 11/1971 Larrimer, Jr. ..... B21D 26/14 72/56
4,610,069 A * 9/1986 Darbois ..... B21D 26/14 285/382.7
5,824,998 A * 10/1998 Livshiz ..... B21D 26/14 219/617
6,474,534 B2 * 11/2002 Gabbianelli ..... B21C 37/154 228/131
6,908,024 B2 * 6/2005 Martin ..... B21D 26/14 228/115

(Continued)

FOREIGN PATENT DOCUMENTS

JP S56-74335 A 6/1981
JP S60-205092 A 10/1985

(Continued)

*Primary Examiner* — Edward T Tolan
(74) *Attorney, Agent, or Firm* — Oliff PLC

(57) ABSTRACT

A pipe assembly includes an inner pipe member and an outer pipe member that is externally fixed to an end portion of the inner pipe member. The inner pipe has a thickness that is less than that of the outer pipe which is placed outside the end portion of the inner pipe member. An additional fixture member is placed outside the portion where the inner and outer pipes are fitted to each other. While the inner pipe, the outer pipe, and the additional fixture are in this state, an electromagnetic coil is placed inside the inner pipe at a position where the outer pipe and the additional fixture are to be fixed. The diameter of the inner pipe increases by applying a pulse current to the electromagnetic coil. The diameter of the outer pipe increases by the action of force applied when the diameter of the inner pipe is increased.

2 Claims, 4 Drawing Sheets

(56) References Cited

U.S. PATENT DOCUMENTS

| | | | | |
|---|---|---|---|---|
| 6,921,013 | B1 * | 7/2005 | Kichline, Jr. | B23K 20/06 228/115 |
| 7,847,223 | B2 * | 12/2010 | Fischer | B21D 26/14 219/607 |
| 2011/0120585 | A1 * | 5/2011 | Hur | B21D 39/04 138/140 |
| 2016/0313161 | A1 * | 10/2016 | Schutze | B21D 39/04 |
| 2018/0372252 | A1 * | 12/2018 | Hundeshagen | F16L 33/225 |
| 2019/0022731 | A1 * | 1/2019 | Yabuoshi | B21D 26/14 |

FOREIGN PATENT DOCUMENTS

| | | | |
|---|---|---|---|
| JP | 2010-131636 | A | 6/2010 |
| JP | 2019-13955 | A | 1/2019 |
| KR | 10-2009-0116192 | A | 11/2009 |
| WO | 2019/009380 | A1 | 1/2019 |

* cited by examiner

METHOD OF MANUFACTURING PIPE ASSEMBLY

CROSS REFERENCE TO RELATED APPLICATION

The entire disclosure of Japanese Patent Application No. 2017-142586 filed on Jul. 24, 2017, including the specification, claims, drawings, and abstract, is incorporated herein by reference in its entirety.

TECHNICAL FIELD

The present disclosure relates to a method of manufacturing a pipe assembly including a pipe and an additional fixture member that is externally fixed to the pipe, the pipe including an inner pipe member and an outer pipe member.

BACKGROUND

JP 2010-131636 A discloses an electromagnetic forming device for electromagnetically expanding a workpiece by passing a current through an electromagnetic coil in a state in which a core member magnetically connected to the electromagnetic coil is inserted into the workpiece that is a metal tube.

SUMMARY

Technical Problem

For example, a pipe assembly may be formed by providing a pipe including an inner pipe member and an outer pipe member externally fixed to an end portion of the inner pipe member, and then, fitting an additional fixture member to the outside of a portion where the inner and outer pipe members are fitted to each other so that these three members are joined and fixed together. When the pipe assembly is manufactured in this manner, the three members may be fixed together by welding. In this method, the pipe assembly will be heavy because of the weight of the welded joints. Alternatively, the three members may also be fixed together by two different steps of electromagnetic forming for swaging. In this method, the manufacturing of the pipe assembly requires a long time.

Solution to Problem

According to one aspect of the present disclosure, there is provided a method of manufacturing a pipe assembly, the pipe assembly including a pipe and an additional fixture member, the pipe including an inner pipe member and an outer pipe member that is externally fixed to an end portion of the inner pipe member. In this method, the additional fixture member is externally fixed to a portion of the pipe where the inner pipe member and the outer pipe member are fitted to each other. The inner pipe member has a thickness that is less than that of the outer pipe member. The method comprises placing the outer pipe member outside the end portion of the inner pipe member in a state in which they are fitted to each other; placing the additional fixture member outside the portion where the inner pipe member and the outer pipe member are fitted to each other; while the inner pipe member, the outer pipe member, and the additional fixture member are in this state, placing an electromagnetic coil inside the inner pipe member at a position where the outer pipe member and the additional fixture member are to be fixed to the inner pipe member; increasing the diameter of the inner pipe member in an area corresponding to where the electromagnetic coil is placed as viewed in the axial direction, at least in part, by applying a pulse current to the electromagnetic coil; and increasing the diameter of the outer pipe member, at least in part, to be larger than an inner circumferential surface of a hole of the additional fixture member through which the outer pipe member is inserted, as viewed in the radial direction by the action of force applied to the outer pipe member when the diameter of the inner pipe member is increased. The inner pipe member, the outer pipe member, and the additional fixture member are simultaneously swaged and fixed together in this manner.

In the method of manufacturing a pipe assembly according to the present disclosure, the weight of the pipe assembly is reduced compared with the structure in which three members, the two inner and outer pipe members and the additional fixture member, are fixed together by welding. Also, the manufacturing time can be shortened compared with the structure in which three members are fixed together by two different steps of electromagnetic forming for swaging.

In the method of manufacturing a pipe assembly according to the present disclosure, the ratio of the thickness of the inner pipe member to the thickness of the outer pipe member is preferably from 0.6 to 0.8.

In this preferred structure, the voltage supplied to the electromagnetic coil will not be excessively high in terms of ensuring a sufficient life of the electromagnetic coil, and the diameter of the outer pipe member is easily increased so that the additional fixture member is fixed to the outer pipe member by the action of force applied as the diameter of the inner pipe member is increased by electromagnetic forming.

In the method of manufacturing a pipe assembly according to the present disclosure, the weight of the pipe assembly is reduced, and the manufacturing time can be shortened.

BRIEF DESCRIPTION OF DRAWINGS

Embodiments of the present disclosure will be described based on the following figures, wherein.

DESCRIPTION OF EMBODIMENTS

Figure 1:
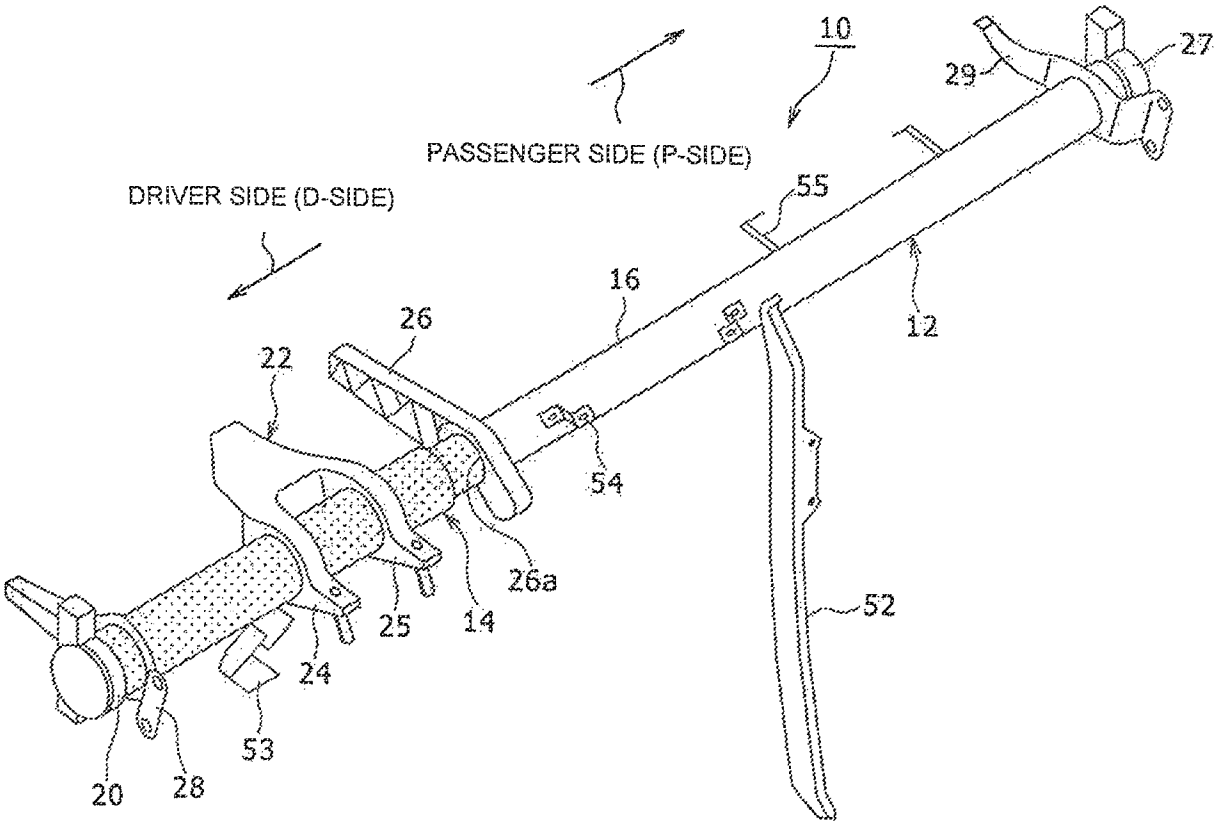
FIG. 1 is a perspective view of a pipe assembly manufactured by a method of manufacturing a pipe assembly according to an embodiment of the present disclosure.

An embodiment of the present disclosure will be described below with reference to the accompanying drawings. Specific shapes, materials, and values specified herein are given by way of example and may be changed as appropriate to suit the specifications of the pipe assembly. As an example of the pipe included in the pipe assembly, an instrument panel reinforcement placed in an instrument panel of a vehicle will be described below. However, the pipe is not limited to this example, and the present disclosure may be applied to various types of structures. In the following disclosure and throughout the drawings, like elements are denoted by the same reference numerals. Reference numerals used earlier in this disclosure will be used in later description where appropriate.

Figure 2:
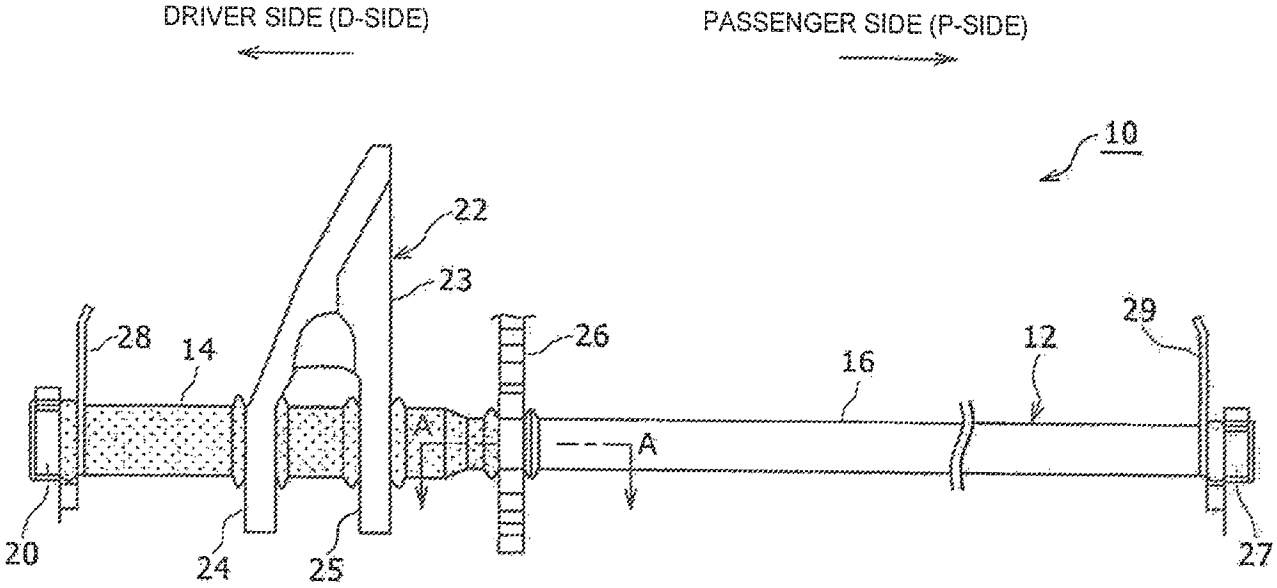
FIG. 2 is a front view of the pipe assembly illustrated in FIG. 1 with some parts not illustrated.

FIG. 1 illustrates a pipe assembly 10 manufactured by a method of manufacturing a pipe assembly according to an embodiment. FIG. 2 is a front view of the pipe assembly 10 illustrated in FIG. 1 with some parts not illustrated. While the method of manufacturing the pipe assembly 10 will be described later, the structure of the pipe assembly 10 will first be described.

The pipe assembly 10 includes a pipe 12 and a cowl brace 26 that is externally fixed to the pipe 12. The cowl brace 26 corresponds to the additional fixture member. The pipe 12 is an instrument panel reinforcement. The instrument panel reinforcement is placed in an instrument panel of a vehicle to lie in the width direction of the vehicle. The instrument panel is attached to the instrument panel reinforcement.

Referring to FIGS. 1 and 2, a plurality of second additional fixture members are also externally fixed to the pipe 12. The plurality of second additional fixture members include a driver-side extension 20, a steering support 22, a passenger-side extension 27, and two outer brackets 28 and 29. The driver-side extension 20, the steering support 22, the cowl brace 26, the passenger-side extension 27, and the outer brackets 28 and 29 are swaged and fixed to the outside of the pipe 12 by electromagnetic forming using an electromagnetic coil placed inside the pipe 12. A floor brace 52 and a plurality of intermediate brackets 53, 54, and 55 are externally fixed by welding at a plurality of positions as viewed in the longitudinal direction of the pipe 12 and in part in the circumferential direction of the pipe 12. The pipe assembly 10 is formed in this manner.

The pipe 12 is formed in a long tubular shape using an electrically conductive metal such as an aluminum alloy. As such, electromagnetic forming is easily performed as the pipe 12 is deformed when a current is applied to an electromagnetic coil that is placed inside the pipe 12, which will be described later.

The pipe 12 includes a D-side pipe member 14 having a long cylindrical shape that is placed on a first end side (left side in FIGS. 1 and 2), which is the driver side ("D-side"), and a P-side pipe member 16 having a long cylindrical shape that is internally fitted and fixed to a second end portion (right end portion in FIGS. 1 and 2) of the D-side pipe member 14. The P-side pipe member 16 is placed such that it extends on the second side as viewed in the axial direction. The D-side pipe member 14 corresponds to the outer pipe member, and the P-side pipe member 16 corresponds to the inner pipe member. In FIGS. 1 and 2, the D-side pipe member 14 is shaded with dots for clear illustration of the positions of the D-side pipe member 14 and the P-side pipe member 16. The material for forming the D-side pipe member 14 and the material for forming the P-side pipe member 16 are the same as each other. For example, the D-side and P-side pipe members 14 and 16 are formed using aluminum alloy 6063, which is suitable for extrusion molding.

Figure 3:
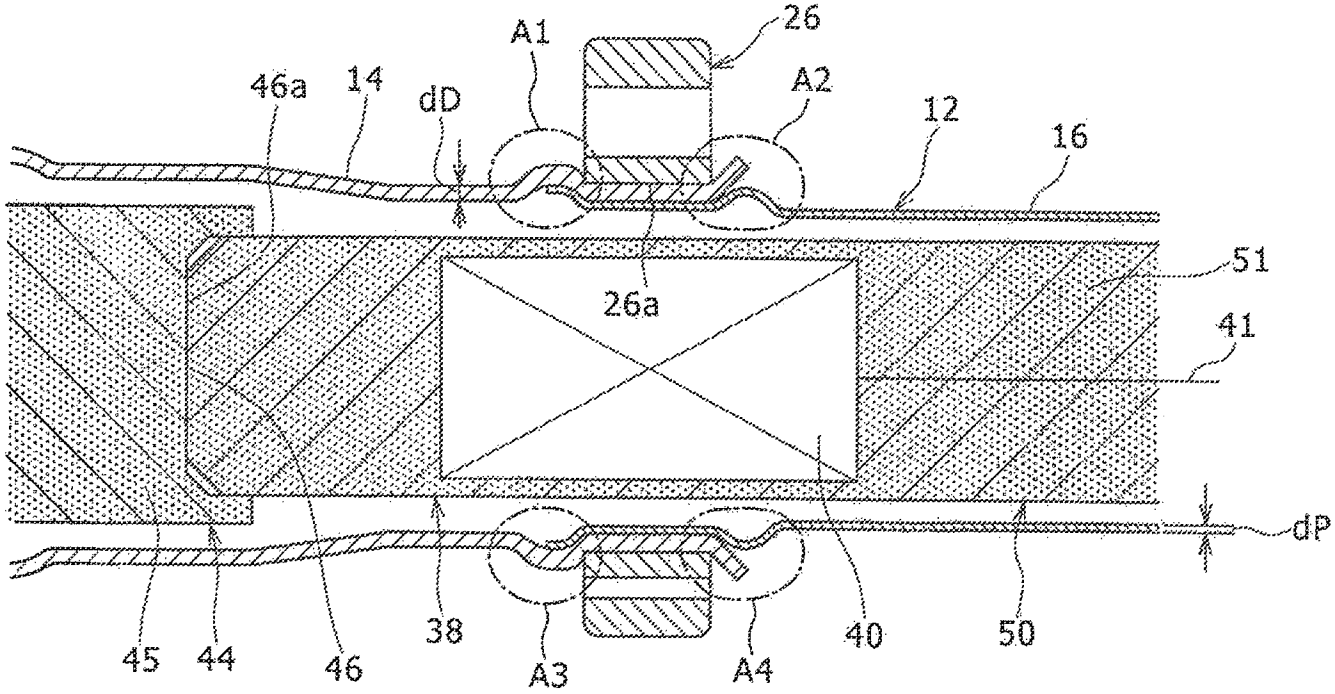
FIG. 3 is an enlarged view of a cross section A-A in FIG. 2.

As illustrated in FIG. 3, which will be described later, a first end portion (left end portion in FIG. 3) of the P-side pipe member 16 as viewed in the axial direction is fitted into the second end portion (right end portion in FIG. 3) of the D-side pipe member 14 as viewed in the axial direction, and they are swaged and fixed together along with the cowl brace 26 by electromagnetic forming. In the illustrated embodiment, the D-side pipe member 14 has an outer diameter and an inner diameter greater than those of the P-side pipe member 16 in portions other than where the D-side pipe member 14 and the P-side pipe member 16 are fitted to each other.

The thickness dP (FIG. 3) of the P-side pipe member 16 is less than the thickness dD (FIG. 3) of the D-side pipe member 14 ($dP<dD$). This feature allows the P-side pipe member 16 to be easily swaged and fixed to the D-side pipe member 14, as the diameter of the P-side pipe member 16 is increased by the action of electromagnetic force produced by applying a pulse current to an electromagnetic coil 40 placed inside the P-side pipe member 16 at a position where the D-side pipe member 14 and the cowl brace 26 are to be fixed, as will be described later.

In a more preferred embodiment, the ratio dP/dD of the thickness dP of the P-side pipe member 16 to the thickness dD of the D-side pipe member 14 is from 0.6 to 0.8.

The D-side extension 20 is fixed to the outside of an end portion of the pipe 12 located on the first side, which is the driver side. The P-side extension 27 is fixed to the outside of an end portion of the pipe 12 located on the second side, which is the passenger side. The D-side and P-side extensions 20 and 27 are fixed to a vehicle body frame (not illustrated) by bolts and nuts or other fastening members. The D-side outer bracket 28 is fixed to the outside of the pipe 12 so as to be adjacent to the D-side extension 20 on the second side (right side in FIGS. 1 and 2) as viewed in the axial direction. The P-side outer bracket 29 is fixed to the outside of the pipe 12 so as to be adjacent to the P-side extension 27 on the first side (left side in FIGS. 1 and 2) as viewed in the axial direction.

The steering support 22 is fixed to the outside of an intermediate portion of the D-side pipe member 14 as viewed in the axial direction. The steering support 22 includes a main portion 23 and two legs 24 and 25 joined to the main portion 23 in a branched manner, and the legs 24 and 25 are fixed to the D-side pipe member 14. A steering column (not illustrated) for supporting a steering shaft is fixed to the steering support 22.

The cowl brace 26 is joined to a member (not illustrated) placed inside the instrument panel. A lower end portion of the floor brace 52 is joined to a floor panel (not illustrated).

A through hole having a circular shape, through which the pipe 12 is inserted, is formed inside each of the driver-side extension 20, the steering support 22, the cowl brace 26, the passenger-side extension 27, and the two outer brackets 28 and 29. For example, a portion of the cowl brace 26 located closer to one end as viewed in the longitudinal direction (a portion located closer to the right end in FIG. 1) has a through hole 26*a*, through which the second end portion of the D-side pipe member 14 passes.

Figure 4:
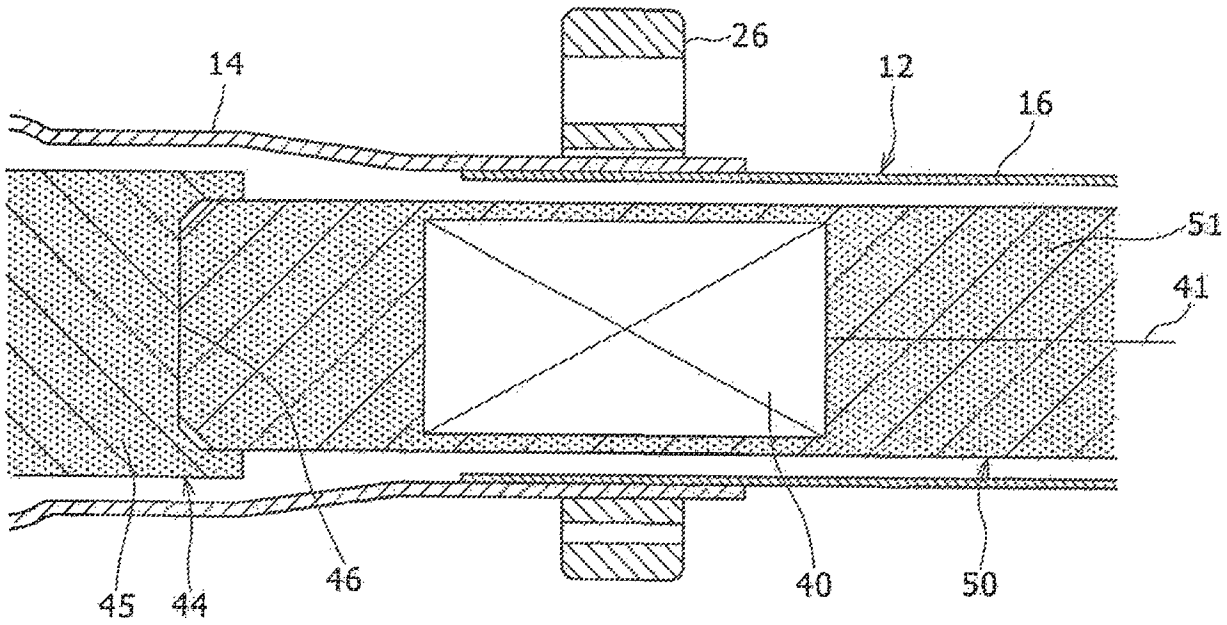
FIG. 4 illustrates a view corresponding to FIG. 3 as seen before a current is applied to an electromagnetic coil.

A method of manufacturing the pipe assembly 10 will be described below with reference to FIGS. 3 and 4. FIG. 3 is an enlarged view of a cross section A-A in FIG. 2. FIG. 4 illustrates a view corresponding to FIG. 3 as seen before a current is applied to the electromagnetic coil 40.

An electromagnetic swaging device 38 for the pipe assembly 10 includes a first shaft member 44 that is inserted from the first end side of the pipe 12 as viewed in the axial direction, which is the driver side, toward the inside, a second shaft member 50 that is inserted from the second end side of the pipe 12 as viewed in the axial direction, which is the passenger side, toward the inside, and a power supply device (not illustrated). The first shaft member 44 is formed by, for example, a resin in a shape like a long cylindrical shaft, and includes a recess 46 having a circular shape in a central portion of the second end surface (right end surface in FIG. 3) as viewed in the axial direction. The recess 46 has a beveled surface having a linear cross section on the circumferential edge of the bottom surface. The bottom surface 46*a* of the recess 46 is in a plane perpendicular to the axis of the first shaft member 44.

The second shaft member 50 is formed by a resin in a shape like a long cylindrical shaft, and includes the electromagnetic coil 40 embedded in the resin 51 inside the first end portion (left end portion in FIG. 3). While the details of the electromagnetic coil 40 are not illustrated, the electromagnetic coil 40 is formed by winding a conductor wire a plurality of times about an axis that is in the same direction as the axial direction of the second shaft member 50. The first end surface (left end surface in FIG. 3) of the second shaft member 50 as viewed in the axial direction is in a plane perpendicular to the axial direction of the second shaft member 50, and the second shaft member 50 has a beveled surface having a linear cross section on the outer circumferential edge of the first end surface as viewed in the axial direction.

The first shaft member 44 is placed inside the D-side pipe member 14, and the second shaft member 50 is placed inside the P-side pipe member 16. The outer diameter of the first shaft member 44 is greater than the outer diameter of the second shaft member 50. When the second shaft member 50 is inserted in the recess 46 of the first shaft member 44, the first end surface of the second shaft member 50 as viewed in the axial direction is brought into abutment with the bottom surface 46*a* of the recess 46. As the diameter of the recess 46 is substantially the same as the outer diameter of the first end portion of the second shaft member 50 as viewed in the axial direction, the first end portion of the second shaft member 50 is placed in position when it enters the recess 46. As such, the first shaft member 44 has the function of placing the electromagnetic coil 40 of the second shaft member 50 in position.

With the first end surface of the second shaft member 50 as viewed in the axial direction being in abutment with the recess 46 of the first shaft member 44 as described above, the electromagnetic coil 40 is placed inside the P-side pipe member 16 at the position where the cowl brace 26 is to be fixed.

The electromagnetic swaging device 38 includes a power supply unit, a controller, and a discharge switch, which are not illustrated. The power supply unit is configured to supply power to the electromagnetic coil 40, and includes a direct-current high-voltage power supply such as a battery, a charge switch, and a capacitor. The power supply unit is connected to the electromagnetic coil 40 via the discharge switch and a wire 41. By turning the discharge switch off and turning the charge switch on, a large amount of charge coming from the direct-current high-voltage power supply is accumulated at the capacitor so that the capacitor is charged. On the other hand, by turning the charge switch off and turning the discharge switch on, a large pulse current is output from the capacitor to the electromagnetic coil 40. The direct-current high-voltage power supply may also include an AC/DC converter that converts alternating-current power supplied from a commercial alternating-current power source into a direct current.

The controller controls the charge switch of the power supply unit, and the discharge switch. The controller is suitably composed of a microcomputer including, for example, a processor, a storage unit such as a memory, and an I/O interface. The controller reads, for example, a program and data stored in the storage unit, and performs a predetermined operation. The controller executes the program to thereby control the operation of the discharge switch and the charge switch so that a pulse current is applied to the electromagnetic coil 40.

The processor may be any type of processor that can achieve a function by executing a program. The processor is composed of one or more electronic circuits. The electronic circuits may be integrated on a single chip or may be implemented on a plurality of chips.

In an embodiment, the method of manufacturing a pipe assembly includes a placement step and an electromagnetic forming step. In the placement step, the second end portion of the D-side pipe member 14 is placed outside the first end portion of the P-side pipe member 16 in a state in which they are fitted to each other. Additionally, the cowl brace 26 and the plurality of second additional fixture members are placed outside the pipe 12 at a plurality of positions where the cowl brace 26 and the plurality of second additional fixture members are to be fixed, as viewed in the axial direction. In this configuration, the P-side pipe member 16 included in the pipe 12 as illustrated in FIG. 4 has a cylindrical shape in a portion where it is fitted to the D-side pipe member 14. The second end portion of the D-side pipe member 14 has a cylindrical shape whose diameter is reduced in steps toward the second end, and the first end portion of the P-side pipe member 16 is fitted inside the second end portion of the D-side pipe member 14 which has a cylindrical shape.

Referring to FIGS. 1 and 2, the extensions 20 and 27, the outer brackets 28 and 29, the steering support 22, and the cowl brace 26 are fixed by means of jigs (not illustrated). Each of the extensions 20 and 27, the outer brackets 28 and 29, the steering support 22, and the cowl brace 26 has a through hole having a circular shape. The D-side pipe member 14 is fitted inside the through holes of the D-side extension 20, the D-side outer bracket 28, and the steering support 22 with a clearance between them. The portion where the D-side pipe member 14 and the P-side pipe member 16 are fitted to each other is fitted inside the through hole 26*a* of the cowl brace 26 with a clearance between them. As such, the cowl brace 26 is placed outside the portion where the D-side pipe member 14 and the P-side pipe member 16 are fitted to each other. The D-side pipe member 14 and the P-side pipe member 16 also are fixed by means of jigs (not illustrated). The second end portion (right end portion in FIGS. 1 and 2) of the P-side pipe member 16 is fitted inside the through holes of the P-side extension 27 and the P-side outer bracket 29 with a clearance between them.

In the placement step, while being in the above-described arrangement, the first shaft member 44 is inserted from the first end of the D-side pipe member 14 toward the inside, and the second shaft member 50 is inserted from the second end of the P-side pipe member 16 toward the inside so that the first end of the second shaft member 50 is brought into abutment with the bottom surface 46*a* of the recess 46 of the first shaft member 44. As such, the electromagnetic coil 40 is placed inside the P-side pipe member 16 at the position where the D-side pipe member 14 and the cowl brace 26 are to be fixed to the P-side pipe member 16, as illustrated in FIG. 4.

In this configuration, the first shaft member 44 and the second shaft member 50 may be guided in the axial direction by means of guide rollers (not illustrated) that are two guides placed outside the pipe 12.

In the electromagnetic forming step, a pulse current is applied to the electromagnetic coil 40 so that the diameter of the P-side pipe member 16 is increased in an area corresponding to where the electromagnetic coil 40 is placed as viewed in the axial direction, at least in part, by the action of electromagnetic force (for example, areas surrounded by alternate long and short dashed lines A1 to A4 in FIG. 3).

The diameter of the D-side pipe member 14 is also increased, at least in part, to be larger than the inner circumferential surface of the through hole 26*a* of the cowl brace 26 through which the D-side pipe member 14 is inserted, as viewed in the radial direction by the action of force applied to the D-side pipe member 14 when the diameter of the P-side pipe member 16 is increased. In this configuration, the electromagnetic coil 40 is placed inside the D-side pipe member 14 with the P-side pipe member 16 interposed between them. As magnetic force produced by the electromagnetic coil 40 is shielded by the P-side pipe member 16, no induction current is generated in the D-side pipe member 14, and therefore, no self-expanding force is produced in the D-side pipe member 14. However, the D-side pipe member 14 expands as it is pushed by the P-side pipe member 16. The D-side pipe member 14, the P-side pipe member 16, and the cowl brace 26 are simultaneously swaged and fixed together in this manner.

After that, the first shaft member 44 and the second shaft member 50 are moved while being in abutment with each other so that the electromagnetic coil 40 is placed either inside the D-side pipe member 14 or inside the P-side pipe member 16 at a position where one of the plurality of second additional fixture members is to be fixed. A pulse current is then applied to the electromagnetic coil 40 so that the diameter of either the D-side pipe member 14 or the P-side pipe member 16 is increased, at least in part, to be larger than the inner circumferential surface of the through hole of the second additional fixture member as viewed in the radial direction. The second additional fixture member is swaged and fixed to either the D-side pipe member 14 or the P-side pipe member 16 in this manner. After the swaging and fixing of this second additional fixture member, the first shaft member 44 and the second shaft member 50 are moved while being in abutment with each other so that the electromagnetic coil 40 is placed either inside the D-side pipe member 14 or inside the P-side pipe member 16 at a position where another second additional fixture member is to be fixed. A pulse current is then applied to the electromagnetic coil 40 so that the second additional fixture member is swaged and fixed to either the D-side pipe member 14 or the P-side pipe member 16. The above-described process is repeated for every second additional fixture member.

The capacitor is charged from the direct-current high-voltage power supply of the power supply unit each time the application of a pulse current to the electromagnetic coil 40 ends.

The cowl brace 26 and the plurality of second additional fixture members are swaged and fixed to the outside of the pipe 12 by electromagnetic forming in this manner.

The electromagnetic swaging device 38 may include an axial movement unit (not illustrated) for moving the first shaft member 44 and the second shaft member 50 in the axial direction.

The electromagnetic swaging device 38 may also include a coil cooling system. The coil cooling system causes the second shaft member 50 to pass in contact with a cooler to which a coolant such as cooling oil or cooling water is supplied. The cooler may be, for example, a container that is formed by a high heat transfer material. With this structure, the electromagnetic coil 40 fixed in the second shaft member 50 can be cooled down.

After the cowl brace 26 and the plurality of second additional fixture members are swaged and fixed to the pipe 12, the floor brace 52 and the plurality of intermediate brackets 53, 54, and 55 are fixed to the pipe 12 by welding. The pipe assembly 10 is formed in this manner.

As the above-described method of manufacturing the pipe assembly 10 eliminates some welded joints compared with the structure in which three members, the D-side and P-side pipe members 14 and 16 and the cowl brace 26, are fixed together by welding, the weight of the pipe assembly 10 is reduced. Also, the manufacturing time can be shortened compared with the structure in which the D-side and P-side pipe members 14 and 16 and the cowl brace 26 are fixed together by two different steps of electromagnetic forming for swaging. For example, when, as an example of different steps of swaging, the D-side pipe member 14 and the cowl brace 26 are fixed together by a first step of electromagnetic forming and the P-side pipe member 16 and the D-side pipe member 14 are fixed together by a second step of electromagnetic forming, the manufacturing time is longer. In an embodiment, as the D-side and P-side pipe members 14 and 16 and the cowl brace 26 can be swaged and fixed together in a single step of electromagnetic forming, the manufacturing time can be shortened.

The thickness dP of the P-side pipe member 16 is less than the thickness dD of the D-side pipe member 14 (dP<dD). This feature allows the P-side pipe member 16 to be easily swaged and fixed to the D-side pipe member 14, as the diameter of the P-side pipe member 16 is increased by the action of electromagnetic force produced by applying a pulse current to the electromagnetic coil 40 placed inside the P-side pipe member 16 at the position where the D-side pipe member 14 and the cowl brace 26 are to be fixed.

As the thickness dD of the D-side pipe member 14 may be relatively large, the strength of the D-side pipe member 14 can be easily increased. For example, as a large bending force is applied to the D-side pipe member 14 from the steering support 22 by a load acting during steering of the steering wheel (not illustrated), the demand for strength is higher for the D-side pipe member 14 than for the P-side pipe member 16. The structure of the illustrated example easily ensures that each of the D-side pipe member 14 and the P-side pipe member 16 has a desired strength. Also, as the thickness of the P-side pipe member 16 may be small, the weight of the pipe assembly 10 is reduced.

The ratio dP/dD of the thickness dP of the P-side pipe member 16 to the thickness dD of the D-side pipe member 14 may be from 0.6 to 0.8. In this case, the voltage supplied to the electromagnetic coil 40 will not be excessively high in terms of ensuring sufficient life of the electromagnetic coil 40. Also, the diameter of the D-side pipe member 14 is easily increased so that the cowl brace 26 is fixed to the D-side pipe member 14 by the action of force applied as the diameter of the P-side pipe member 16 is increased by electromagnetic forming. On the other hand, the ratio dP/dD may also be less than 0.6. In this case, as the thickness dD of the D-side pipe member 14 is excessively large relative to the thickness dP of the P-side pipe member 16, in some cases, the diameter of the D-side pipe member 14 is not easily increased by the action of force produced by deformation of the P-side pipe member 16. Also, the ratio dP/dD may also be in the range of less than 1.0 and greater than 0.8. However, the voltage supplied to the electromagnetic coil 40 should be significantly higher than a normal level. In this case, the life of the electromagnetic coil 40 may be significantly shortened by heat produced by the electromagnetic coil 40 itself. This disadvantage can be removed by controlling the ratio dP/dD to fall in the range of from 0.6 to 0.8.

The thickness dD of the D-side pipe member 14 and the thickness dP of the P-side pipe member 16 may be such that, when, for example, the outer diameter of the electromagnetic coil 40 is approximately 50 mm, the thickness dP is 1.2 mm, and the thickness dD is 2.0 mm. In this case, the ratio dP/dD is 0.6. Alternatively, the thickness dP may be 1.6 mm, and the thickness dD may be 2.6 mm. In this case as well, the ratio dP/dD is 0.6. As a further alternative, the thickness dP may be 1.6 mm, and the thickness dD may be 2.0 mm. In this case, the ratio dP/dD is 0.8.

Further, when the outer diameter of the electromagnetic coil 40 is increased to approximately 110 mm, for example, the thickness dP may be 1.8 mm, and the thickness dD may be 3.0 mm. In this case, the ratio dP/dD is 0.6. In this configuration, as the thickness dP of the P-side pipe member 16 is large, a high voltage is supplied to the electromagnetic coil 40 as required for swaging the P-side pipe member 16 by electromagnetic forming. On the other hand, even if the supplied voltage is high as described above, as the outer diameter of the electromagnetic coil 40 is increased, the wire diameter of the electromagnetic coil 40 can be increased. Even when the absolute amount of the thickness dP of the P-side pipe member 16 is large as described above, the voltage supplied to the electromagnetic coil 40 can be prevented from becoming excessively high in terms of ensuring sufficient life of the electromagnetic coil 40 by controlling the ratio dP/dD to fall in the range of from 0.6 to 0.8. As such, heat generation by the electromagnetic coil 40 itself can be suppressed.

It should be noted that although, in the above-described example, the P-side pipe member 16, the D-side pipe member 14, and the cowl brace 26 are simultaneously swaged and fixed together, the additional fixture member that is swaged and fixed simultaneously with the D-side and P-side pipe members 14 and 16 is not limited to the cowl brace 26 and may be any different component that is externally fixed to the pipe 12.

The invention claimed is:

1. A method of manufacturing a pipe assembly, the pipe assembly including a pipe and an additional fixture member, the pipe including an inner pipe member and an outer pipe member that is externally fixed to an end portion of the inner pipe member, wherein the additional fixture member is externally fixed to a portion of the pipe where the inner pipe member and the outer pipe member are fitted to each other, and wherein the inner pipe member has a thickness that is less than that of the outer pipe member, the method comprising:

placing the outer pipe member outside the end portion of the inner pipe member in a state in which the outer pipe member and the inner pipe member are fitted to each other;

placing the additional fixture member outside the portion where the inner pipe member and the outer pipe member are fitted to each other;

while the outer pipe member is placed outside the end portion of the inner pipe member in the state in which the outer pipe member and the inner pipe member are fitted to each other and while the additional fixture member is placed outside the portion where the inner pipe member and the outer pipe member are fitting to each other, placing an electromagnetic coil inside the inner pipe member at a position where the outer pipe member and the additional fixture member are to be fixed to the inner pipe member;

increasing the diameter of the inner pipe member in an area corresponding to where the electromagnetic coil is placed as viewed in the axial direction, at least in part, by applying a pulse current to the electromagnetic coil; and increasing the diameter of the outer pipe member, at least in part, to be larger than an inner circumferential surface of a hole of the additional fixture member through which the outer pipe member is inserted, as viewed in the radial direction by the action of force applied to the outer pipe member when the diameter of the inner pipe member is increased, wherein the inner pipe member, the outer pipe member, and the additional fixture member are simultaneously swaged and fixed together, and the ratio of the thickness of the inner pipe member to the thickness of the outer pipe member is from 0.6 to 0.8.

2. The method according to claim 1, wherein placing an electromagnetic coil inside the inner pipe member at a position where the outer pipe member and the additional fixture member are to be fixed to the inner pipe member comprises:

inserting a first shaft member from a first end of the pipe assembly; and inserting a second shaft member from a second end of the pipe assembly, the second shaft member being formed by a resin, and the second shaft member including the electromagnetic coil embedded inside an end portion of the second shaft member, wherein the end portion of the second shaft member is first inserted and is brought into abutment with an end surface of the first shaft member.

* * * * *